US010583540B2

(12) United States Patent
Wallendorf et al.

(10) Patent No.: US 10,583,540 B2
(45) Date of Patent: Mar. 10, 2020

(54) DEVICE FOR FINE PROCESSING OF OPTICALLY EFFECTIVE SURFACES ON, IN PARTICULAR, EYEGLASS LENSES

(71) Applicant: Satisloh AG, Baar (CH)

(72) Inventors: Steffen Wallendorf, Wetzlar-Dutenhofen (DE); Holger Schäfer, Weilmünster (DE); Peter Philipps, Dillhausen (DE); Andreas Kaufmann, Hohenahr-Altenkirchen (DE)

(73) Assignee: Satisloh AG, Baar (CH)

( * ) Notice: Subject to any disclaimer, the term of this patent is extended or adjusted under 35 U.S.C. 154(b) by 271 days.

(21) Appl. No.: 15/519,643

(22) PCT Filed: Sep. 17, 2015

(86) PCT No.: PCT/EP2015/001857

§ 371 (c)(1),
(2) Date: Apr. 17, 2017

(87) PCT Pub. No.: WO2016/058663

PCT Pub. Date: Apr. 21, 2016

(65) Prior Publication Data

US 2017/0246720 A1 Aug. 31, 2017

(30) Foreign Application Priority Data

Oct. 15, 2014 (DE) ..... 10 2014 015 053

(51) Int. Cl.
*B24B 13/00* (2006.01)
*B24B 27/00* (2006.01)
*B24B 9/14* (2006.01)

(52) U.S. Cl.
CPC ..... *B24B 13/0037* (2013.01); *B24B 9/14* (2013.01); *B24B 27/0076* (2013.01)

(58) Field of Classification Search
CPC ... B24B 13/0037; B24B 9/14; B24B 27/0076; B24B 27/0061
See application file for complete search history.

(56) References Cited

U.S. PATENT DOCUMENTS 2,994,164 A * 8/1961 Dalton ..... B24B 13/0037 451/262
3,302,337 A * 2/1967 Milner, Jr. ..... B24B 9/14 451/240

(Continued)

FOREIGN PATENT DOCUMENTS

CN 201552483 U 8/2010
CN 201889693 U 7/2011

(Continued)

OTHER PUBLICATIONS

Chinese Office Action; Applicant: Satisloh, AG; Application No. 2018073101275250; dated Aug. 3, 2018; 12 Pages.

(Continued)

*Primary Examiner* — Timothy V Eley
*Assistant Examiner* — Marcel T Dion
(74) *Attorney, Agent, or Firm* — Reising Ethington P.C.

(57) ABSTRACT

A device for fine processing of optically effective surfaces on workpieces has a workpiece spindle which protrudes into a working space and by which a workpiece to be polished can be rotationally driven about a workpiece axis of rotation. Two tool spindles are associated with the workpiece spindle and protrude into the working space oppositely to the workpiece spindle. On each tool spindle, a polishing tool can be rotationally driven about a tool axis of rotation and is retained so that the polishing tool can be axially advanced along the tool axis of rotation. Furthermore, the tool spindles can be moved together in relation to the workpiece spindle along a linear axis extending substantially perpendicularly to the workpiece axis of rotation and can be pivoted about (Continued)

different pivoting adjustment axes, which extend substantially perpendicularly to the workpiece axis of rotation and substantially perpendicularly to the linear axis.

21 Claims, 9 Drawing Sheets

(56) References Cited

U.S. PATENT DOCUMENTS

| | | | | |
|---|---|---|---|---|
| 5,906,534 | A | 5/1999 | Folkman et al. | |
| 6,155,911 | A | 12/2000 | Mandler | |
| 6,244,943 | B1 * | 6/2001 | Bohler | B24B 11/00 451/294 |
| 7,422,510 | B2 * | 9/2008 | Schneider | B24B 27/0061 451/10 |
| 7,455,569 | B2 | 11/2008 | Schäfer et al. | |
| 7,559,829 | B2 | 7/2009 | Stephane et al. | |
| 8,696,410 | B2 | 4/2014 | Schäfer et al. | |
| 9,089,948 | B2 | 7/2015 | Schäfer et al. | |
| 9,289,877 | B2 | 3/2016 | Schäfer et al. | |
| 2007/0155287 | A1 * | 7/2007 | Drain | B24B 41/04 451/11 |
| 2007/0293128 | A1 * | 12/2007 | Schafer | B24B 13/0037 451/7 |
| 2012/0135672 | A1 * | 5/2012 | Schafer | B24B 13/02 451/548 |
| 2012/0211942 | A1 * | 8/2012 | Smith | F16J 9/22 277/300 |
| 2013/0232774 | A1 * | 9/2013 | Nakako | B24B 27/0076 29/650 |
| 2013/0344778 | A1 * | 12/2013 | Schafer | B24B 13/023 451/294 |
| 2014/0183025 | A1 * | 7/2014 | Kamen | C02F 1/041 202/185.1 |
| 2015/0038061 | A1 * | 2/2015 | Wallendorf | B24B 13/00 451/70 |

FOREIGN PATENT DOCUMENTS

| | | |
|---|---|---|
| DE | 29803158 | 8/1998 |
| DE | 19832724 | 3/1999 |
| DE | 10106659 A1 | 8/2002 |
| DE | 202011107121 | 12/2011 |
| EP | 1955811 A2 | 8/2008 |

OTHER PUBLICATIONS

European Search Report; No. PCT/EP2015/001857 dated Feb. 8, 2016; 13 pages.

German Office Action; Applicant: Satisloh AG; Appln. No. 10 2014 015 053.4; dated Sep. 24, 2015.

* cited by examiner

DEVICE FOR FINE PROCESSING OF OPTICALLY EFFECTIVE SURFACES ON, IN PARTICULAR, EYEGLASS LENSES

TECHNICAL FIELD

The present invention relates in general to a device for fine processing of optically effective surfaces. In particular, the invention relates to a device for fine processing of the optically effective surfaces of spectacle lenses that are used on a large scale in so-called "RX workshops", i.e. production facilities for manufacture of individual spectacle lenses according to prescription.

If in the following, by way of example, reference is made to "spectacle lenses" for workpieces with optically effective surfaces there is to be understood by that not only spectacle lenses of mineral glass, but also spectacle lenses of all other customary materials for example polycarbonate, CR 39, HI index and other plastic material.

BACKGROUND OF THE INVENTION

Processing of optically effective surfaces of spectacle lenses by material removal can be roughly divided into two processing phases, namely initially preparatory processing of the optically effective surface for producing the macrogeometry in accordance with prescription and then fine processing of the optically effective surface in order to eliminate preparatory processing tracks and obtain the desired microgeometry. Whereas preparatory processing of the optically effective surfaces of spectacle lens is carried out in dependence on, inter alia, the material of the spectacle lenses by grinding, milling and/or turning, in fine processing the optically effective surfaces of spectacle lenses are usually subjected to a precision-grinding, lapping and/or polishing process, for which purpose use is made of an appropriate machine. To that extent, in the terminology of the present application the term "polishing", including expressions such as, for example, "polishing tool" or the like, is to embrace precision-grinding and lapping processes, in the example thus precision-grinding or lapping tools.

Manually loaded polishing machines in RX workshops, in particular, are usually constructed as "twin machines" so that advantageously two spectacle lenses of an "RX job"—a spectacle lens prescription always relates to a pair of spectacle lenses—can be subjected to fine processing simultaneously. Such "twin" polishing machines are known from, for example, documents U.S. Pat. Nos. 8,696,410 and 9,289,877, which disclose a related machine kinematics.

According to, for example, the last-mentioned document (see, in particular, FIGS. 1 to 5 thereof) such a polishing machine comprises a machine housing bounding a work space into which project two workpiece spindles, by way of which the two spectacle lenses to be polished can be driven by a rotary drive to rotate about substantially mutually parallel workpiece axes of rotation C1, C2. On the tool side, the polishing machine has a first linear drive unit by which a first tool carriage is movable along a linear axis X extending substantially perpendicularly to the workpiece axes of rotation C1, C2, a pivot drive unit which is arranged on the first tool carriage and which pivots a pivot yoke about a pivot setting axis B extending substantially perpendicularly to the workpiece axes of rotation C1, C2 and substantially perpendicularly to the linear axis X, a second linear drive unit which is arranged on the pivot yoke and by which moves a second tool carriage along a linear setting axis Z extending substantially perpendicularly to the pivot setting axis B, and two tool spindles each with a respective tool mounting section, wherein each of the tool mounting sections projects into the work space to be associated with a respective one of the workpiece spindles.

Each tool spindle has a spindle shaft on which the respective tool mounting section is formed and which is mounted in a spindle housing to be driven to rotate about a tool axis of rotation A1, A2, which housing in turn is guided in a guide tube to be capable of defined axial displacement in the direction of the tool axis of rotation. Whereas the spindle housings of the two tool spindles are flange-mounted on the second tool carriage, the guide tubes are mounted on the pivot yoke so that as a result the tool axis of rotation A1 or A2 of each tool spindle forms with the workpiece axis of rotation C1 or C2 of the associated workpiece spindle a plane in which the respective tool axis of rotation A1 or A2 is axially displaceable (linear axis X, linear setting axis Z) and tiltable (pivot setting axis B) with respect to the workpiece axis of rotation C1 or C2 of the associated workpiece spindle.

By virtue of the given possibilities of movement, the prior art polishing machine allows—with a compact construction—pairwise processing of spectacle lenses not only by a so-called "tangential polishing kinematic" in which the polishing tools axially adjusted (Z) together with the tool spindles are moved under a preset, but fixed, pivot angle (B) of the tool spindles in oscillation with relatively small strokes transversely (X) over the spectacle lenses, but also with a polishing kinematic in which the adjusted (Z) polishing tools during the oscillating transverse movement (X) thereof at the same time continuously pivot (B) so as to follow the surface curvature of the spectacle lenses, wherein the spectacle lenses and the polishing tools can be driven (but do not have to be at least as far as the polishing tools are concerned) in the same sense or opposite sense at the same or different rotational speeds about the axes of rotation (A1, A2, C1, C2) thereof.

To that extent, it is certainly advantageous that this polishing machine can be widely used. However, in the case of specific materials which are difficult to polish such as, for example, polycarbonate materials or high-index material it is still desirable to process with different polishing bases in order to reduce polishing times and/or achieve specific surface qualities, which in the afore-described prior art would require a change of polishing tools. The same applies if spectacle lenses to be polished in succession significantly differ in the geometry thereof (surface curvature, diameter). Tool change times thus required can indeed be significantly reduced for industrial production by use of automated tool changers with tool magazines, but this would be involve a substantial outlay on equipment.

What is desired is a device, which is constructed as simply and compactly as possible, for fine processing of optically effective surfaces of, in particular, spectacle lenses, the device being usable as widely as possible and thus allowing different processing strategies without requiring longer processing times.

SUMMARY OF THE INVENTION

According to one aspect of the invention a device for fine processing of optically effective surfaces of, in particular, spectacle lenses as workpieces comprises a workpiece spindle, which projects into a work space and by way of which a workpiece to be polished is drivable for rotation about a workpiece rotational axis C, and two tool spindles which are associated with the workpiece spindle and project oppositely into the work space and on each of which a respective polishing tool is mounted to be drivable for rotation about a tool rotational axis A, A' and to be axially adjustable (Z) along the tool rotational axis A, A', the tool spindles being movable relative to the workpiece spindle in common along a linear axis X extending substantially perpendicularly to the workpiece rotational axis C and being pivotable about different pivot setting axes B, B' extending substantially perpendicularly to the workpiece rotational axis C and substantially perpendicularly to the linear axis X, wherein the tool spindles are arranged in succession as seen in the direction of the linear axis X.

Due to the fact that at the outset the tool spindles are arranged in succession as seen in the direction of the linear axis X the device according to the invention is of advantageously compact construction, which makes it apposite for use as a polishing cell in a polishing machine with a plurality of devices according to the invention. In that case, it is conducive to simple construction of the device as well as with respect to energy efficiency that the two tool spindles are not only movable in common along the linear axis X, but also pivotable in common about the different pivot setting axes B, B', since only one drive is thus needed for each of these linear or pivot movements.

Even a polishing machine in which only one device according to the invention is used (basic version) makes possible different processing methods and thus is very flexible: It is observed at the outset that due to the relevant combination of axes (A, B, C, X, Z), all polishing processes described above with respect to the prior art can be carried out on a workpiece by the device according to the invention, in specific circumstances even without an individual rotary drive for the tool.

If different polishing tools are used at the two tool spindles of one device it is possible to carry out, for example, preparatory polishing and fine polishing with different polishing coatings in one tool chucking, which makes very short polishing times possible with, at the same time, increased surface quality.

It is also possible, by comparison with the prior art outlined in the introduction, to increase the working range of the device by use of polishing tools of different size (tool diameter) and/or different curvature (tool radius of curvature) at the two tool spindles of one device. Thus, for example, very small or very large workpieces with, in a given case, strongly curved surfaces can be processed by the device without a tool change having to be undertaken for that purpose, which consequently is helpful towards achieving shorter overall processing times.

In the case of use of the device in the production of spectacle lenses to prescription it is additionally possible to polish not only concavely curved, but also convexly curved spectacle lenses with the same polishing tool or, however, with polishing tools shaped in correspondence with the respective spectacle lens curvature (cc or cx). Such a combined operation in polishing-processing is particularly advantageous with regard to the currently increasing presence of spectacle lenses with aspherical or progressive surfaces on both sides.

Moreover, it is possible to use an identical polishing tool at both tool spindles of one device so that in the event of wear of one tool, for example after a predetermined number of polished workpieces, an automatic spindle change and thus tool change can be carried out.

A further processing variant with one device and identical polishing tools would be utilization of the tool spindles in alternation during processing of a workpiece or from workpiece to workpiece. This would have the advantage that the respective polishing tool out of use and the corresponding tool spindle together with drive could cool down in the pause, with the result of uniform wear, a controlled machine heating cycle and/or increased tool service lives.

If in a polishing machine for simultaneous polishing of at least two spectacle lenses there is use, in correspondence with the number of spectacle lenses to be polished simultaneously, of at least two devices according to one aspect of the invention as polishing cells, which advantageously can be realized by a modular arrangement in a common machine frame, the possible processing strategies are even more numerous. At the outset, by contrast to a polishing machine according to the prior art outlined in the introduction, in which the two tool spindles are always moved in common linearly (X) or pivotably (B) relative to the two workpiece spindles associated therewith, in the case of processing only one spectacle lens—which can be necessary, for example, for refinishing—the other tool spindle does not have to be conjunctively moved non-operationally and disadvantageously in terms of energy consumption.

Moreover, a polishing process, which is optimal for the respective spectacle lens prescription and has individually selectable oscillation strokes, oscillation frequencies, angles of incidence, rotational speeds, polishing times and polishing pressures can be performed in each device or polishing cell of the polishing machine. By contrast to the above prior art, it is not necessary to accept a compromise which in the case of the prior art polishing machines may ultimately lead to longer processing times than necessary and to worse surface qualities than possible.

If, for example, three devices according to the invention are used as polishing cells in a polishing machine a pair of spectacle lenses can be simultaneously processed with individual process parameters per spectacle lens in two polishing cells, while in the third polishing cell—with suitable tool fit—it is possible to carry out at the same time "special work" such as the processing of specific geometries (for example large diameters and/or strong curvatures), refinishing work or prescriptions with only one prescription lens (if the second spectacle lens is a standard lens).

In the developed version of a polishing machine described above the individual devices according to the invention can be arranged in the machine frame in, for example, star shape around a central operator position, which can have advantages for machine loading. However, it is currently preferred if the devices are arranged adjacent to one another in such a polishing machine so that the respective linear axes X, X', X" extend substantially parallel to one another, which not only represents a space-saving arrangement, but also facilitates automation, particularly of the workpiece change.

In an automated version developed even further the polishing machine can thus comprise a transfer station optionally with a conveyor belt, for the deposit of prescription boxes for reception of spectacle lenses which are to be polished and are polished, a washing station for washing the polished spectacle lens and—for further increase in productivity—a portal handling system, which automatically transports the spectacle lenses between the stations and the devices and positions the spectacle lenses in the respective station or device. If a conveyor belt is not used, the transfer station could also be designed so that several prescription boxes could be deposited in a position reachable by the portable handling system or so that the portal handling system can displace the receptacle box into/onto the transfer station. In principle, a robot handling system or a hexapod system, which could be displaceably arranged on a rail in front of the polishing cells or at a carriage to hang at the front above the polishing cells, would also be conceivable for workpiece handling, such solution however would be much more expensive.

In that regard, in an advantageous embodiment the portal handling system can comprise a suction unit, which is movable in space, for holding a spectacle lens, which is to be polished, at the optically effective surface to be polished as well as a multi-finger gripper, which is movable in space, for holding a polished spectacle lens at the edge thereof. The advantage of use of a multi-finger gripper is that this does not contact the polished surface, but grips only the edge of the spectacle lens, so that the risk of imprinting or scratching the polished surface during workpiece handling is precluded. On the other hand, the suction unit can be used without problems on blanks as a reliable and robust solution.

In principle, it would be possible with the device according to one aspect of the invention, as such, for the pivot setting axes B, B' of a device to lie at different heights with respect to the linear axis X, which, assuming an invariable height of the workpiece spindle, would allow or require different axial strokes and/or pivot angles of the polishing tools from tool spindle to tool spindle. In addition, with respect to the possibility of use of identical components it is, however, preferred if the pivot setting axes B, B' lie in a notional plane extending along the linear axis X or parallel thereto. Each tool spindle thus has the same kinematic boundary conditions; tool strokes and thus stiffnesses are identical, as a result of which there is to that extent freedom of selection for the positioning of the polishing tools at the front and rear tool spindles.

In a simpler and more compact design of the tool-oscillation and tool-pivotation possibilities of movement with shortest practicable travel paths the arrangement is preferably such that one tool spindle is mounted on a front pivot yoke which is pivotably connected with a tool carriage to be pivotable in defined manner about one pivot setting axis B, whereas the other tool spindle is mounted on a rear pivot yoke which is pivotably connected with the same tool carriage to be pivotable in defined manner about the other pivot setting axis B', the tool carriage in turn being drivable along the linear axis under guidance with respect to a frame surrounding the work space.

In that case, for movement and positioning of the tool carriage guided at two guide rods connected with the frame there is preferably provided a rotary drive which is stationary with respect to the frame and which is drivingly connected with a ball screw drive comprising a rotatably mounted ball screw spindle engaging a nut connected with the tool carriage to be secure against relative rotation. In principle, the use of other linear guides and drives would, in fact, also be conceivable, for example linear motors or the like, but on the other hand the above preferred embodiment of guide and drive is more economic for a high level of stiffness and insensitivity relative to dirt.

Fundamentally, it would be possible to provide an individual drive for the pivot movement of each pivot yoke, for example a respectively associated torque motor. However, for preference for defined pivotation of the two tool spindles about the pivot setting axes B, B' a linear drive is provided which is pivotably connected by one end thereof with one pivot yoke at a spacing from the corresponding pivot setting axis B and by the other end thereof with the tool carriage, wherein that pivot yoke is in addition disposed in drive connection with the other pivot yoke by way of a coupling rod, which at a spacing from the pivot setting axes B, B' is pivotably connected by one end thereof with said one pivot yoke and by the other end thereof with said other pivot yoke. In a preferred embodiment the device thus advantageously has only a single drive for pivotation of the two tool spindles.

Sofar as the axial adjusting movement of the polishing tools is concerned it is preferred if each tool spindle comprises, for axial adjustment of the respective polishing tool along the associated tool axis of rotation A, A', a piston-cylinder arrangement with a piston which is received in a cylinder housing and which is connected with a spindle shaft in coaxial arrangement to be effective in terms of actuation, the spindle shaft being mounted together with the piston-cylinder arrangement in a spindle housing to be rotatable about the respective tool axis of rotation A, A'. This construction is distinguished particularly by low weight, in which case, in particular, axial movements can be executed in highly dynamic manner, which in turn makes possible short processing times with very high polishing quality, since the polishing tool can always follow the workpiece even when there are relatively substantial departures from rotational symmetry at the workpiece.

In that regard, the cylinder housing of the pneumatically actuable piston/cylinder arrangement is preferably of two-part construction and lined with a guide sleeve of mineral glass, in which the piston, which is made from a graphite material at its guide surface, is received to be longitudinally displaceable. A significant advantage of such a "glass cylinder" results from its very low stick/slip tendency; thus, the device can operate sensitively even with very low polishing pressures.

According to an advantageous development the piston of the piston-cylinder arrangement can additionally be connected in tension-resistant and compression-resistant manner with the spindle shaft by way of a thin rod of a spring steel. Such a very light and play-free force transmission element provides, in simple manner, a possibility of radial compensation, as a result of which jamming cannot occur if the center axes of the piston or the piston-cylinder arrangement and the spindle shaft are not correctly aligned.

If a rotary drive at the polishing tool is desired, the cylinder housing can be provided at the outer circumference with a toothing for engagement of a cogged belt drivable by way of a motor, which is flange-mounted on the respective pivot yoke, with a belt pulley so as to rotate the piston-cylinder arrangement and thus the spindle shaft about the respective tool axis of rotation A, A'. Such a rotary drive resulting from standard drive elements is not only favorable in cost, but has—by comparison with an equally conceivable rotary drive arranged coaxially with the spindle shaft as shown and described in the prior art defining the category—the advantage of smaller moved masses, which in turn is conducive to high quality of the polished surface with short processing times. Use of a gearwheel transmission is also conceivable as a further, particularly low-wear, alternative for transmission of torque to the spindle shaft from a rotary drive arranged parallel to the spindle shaft. In that case, a gearwheel of steel can be provided at the drive side, the gearwheel meshing with gearwheel of the same size at the spindle side and of plastics material (translation ratio 1:1), in which case the two gearwheels can be provided with a bevel toothing so that as a result the gearwheel pair also runs with very low noise output.

Corresponding advantages in terms of mass are applicable to a preferred construction in which for torque transmission from the cylinder housing of the piston-cylinder arrangement to the spindle shaft a splined shaft guide—thus again inexpensive standard elements—is provided, with guide grooves formed in the spindle shaft and a flanged nut engaging therewith by way of an axial bearing element and connected with the cylinder housing to be secure against relative rotation.

In further pursuit of one aspect of the invention the polishing tool can comprise a tool mounting head, which is securable to the respective spindle shaft to be capable of axial and rotational entrainment and on which a polishing disc is exchangeably mounted, for which purpose a base body of the polishing disc and the tool mounting head are provided with complementary structures for axial detenting and for rotational entrainment of the polishing disc by the tool mounting head. This produces, on the one hand, an uncomplicated capability of exchange of the polishing plate as well as secure mounting of the polishing disc on the respective tool spindle and, on the other hand, a defined mechanically positive transmission of torque between the tool mounting head and polishing disc during the polishing process.

In one embodiment the tool mounting head can comprise a ball joint with a ball head, which is received in a ball socket and which is formed at a ball pin securable to the spindle shaft of the respective tool spindle, whereas the ball socket is formed in a mounting plate with which the polishing disc is detentable. This makes possible, in simple manner, tilting of the polishing disc relative to the spindle shaft of the respective tool spindle during the polishing process so that the polishing disc can readily follow the most diverse spectacle lens geometries, even, for example, cylindrical surfaces or progressive surfaces with high additions. Moreover, the tiltability of the polishing disc advantageously permits execution of polishing processes with the already discussed "tangential polishing kinematic", in which case the polishing disc is capable of orientation in terms of angle at the spectacle lens.

In a preferred embodiment the ball head can have a receiving bore for a transverse pin which extends through the ball head and on either side of the ball head engages in associated recesses in the ball socket so as to connect the mounting plate with the ball pin to be capable of rotational entrainment. Such a configuration of the ball head as a universal joint makes it possible, in simple manner, to rotationally drive the polishing plate, which by comparison with an equally conceivable, purely frictionally produced rotational entrainment of the polishing disc by the spectacle lens enables significantly shorter polishing times. Fundamentally, with respect to tiltability and to a rotational drive possibility something similar could, in fact, also be realized by use of a homokinetic joint, but this would involve a significantly greater amount of complication and higher costs.

In addition, it is preferred if the mounting plate is resiliently supported by way of a resilient annular element on a support flange at the ball pin side in such a way that the polishing disc detented with the mounting plate seeks to self-align by its center axis with the ball pin and thus the spindle shaft of the respective tool spindle. The polishing disc is thereby prevented from excessive tilt movements, which on the one hand has a favorable effect particularly during movement reversal in the case of the mentioned oscillation of the polishing disc over the spectacle lens, since the polishing disc cannot bend away and as a consequence jam at the spectacle lens. On the other hand, such a resilient support of the mounting plate of the polishing tool is of advantage during mounting or positioning of the polishing disc, because the mounting plate adopts a defined position with slight constraint. The movement together of polishing disc and spectacle lens can, in addition, take place in such a manner as a consequence of the resilient (pre-)orientation of the mounting plate that the polishing disc is placed, substantially axially oriented, on the spectacle lens and not, for example, tipped, which could lead to problems particularly in the case of thick or elevated polishing discs. In principle, it would in fact also be possible to manage such (pre-)orientation of the polishing disc by means of a pneumatically influenced rubber bellows at the mounting plate, but this would be far more complicated.

In a further preferred embodiment of the device the tool mounting head in an axially retracted setting of the spindle shaft is detentable by a detent device with a cylinder housing or a part connected therewith to be secure against relative rotation. Thus, with advantage, in the retracted setting of the spindle shaft it is not necessary to expend any energy—such as, for example, in the application of a sub-atmospheric pressure to the afore-described piston-cylinder arrangement of the tool spindle—in order to hold the tool mounting head in the retracted setting for, for example, change of the polishing tool. In fact, other measures would also be conceivable for that purpose such as, for example, retention by permanent or electrically generated magnetic force, but this would be more complicated and possibly problematic with respect to simple attainment of low breakaway moments.

In an embodiment which is advantageous because it is less expensive and is simpler, the detent device can comprise a plurality of spring projections which are distributed over the circumference of the tool mounting head and project along the respective tool axis of rotation A, A' and which mechanically positively engage with lugs in an annular groove, which is formed at the cylinder housing or the part connected therewith to be secure against relative rotation. Components of that kind can be produced without problems from plastics material, optionally even by injection molding for larger batch numbers.

Finally, it is particularly preferred if a lower region of the work space into which the workpiece spindle projects is bounded by a trough, which is integrally deep-drawn from a plastics material, with step-free wall surfaces. Advantages of such a trough, which in a given case is also coated to be hydrophobic, are—apart from corrosion resistance—that by comparison with an equally conceivable welded stainless steel trough the polishing medium readily drains and the work space is easy to clean and to keep satisfactorily sealed.

BRIEF DESCRIPTION OF THE DRAWINGS

The invention is explained in more detail in the following by way of a preferred embodiment with reference to the accompanying, partly simplified or schematic drawings, which are not to scale and in which.

DETAILED DESCRIPTION OF THE EMBODIMENT

Figure 1:
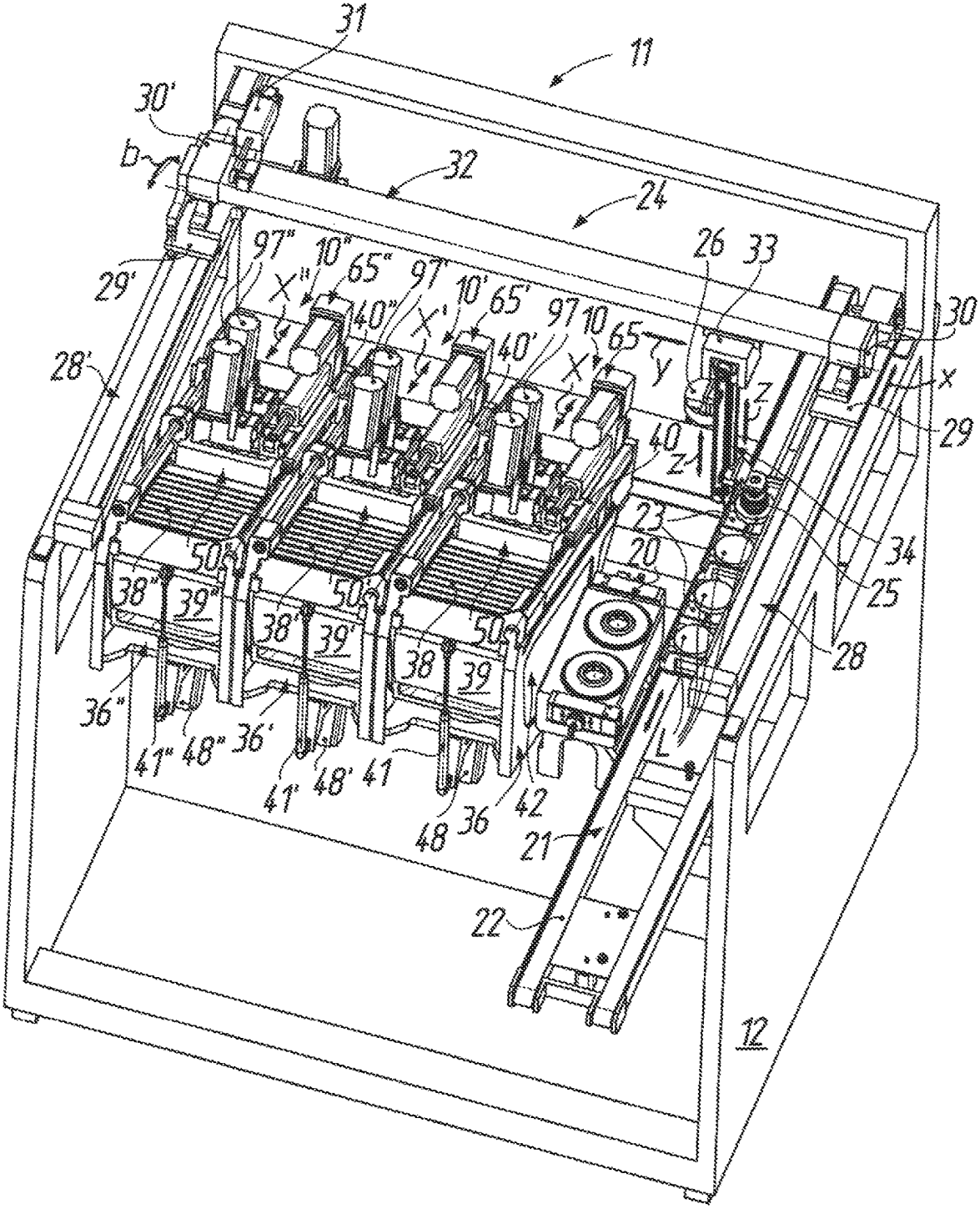
FIG. 1 shows a perspective view of a polishing machine for spectacle lenses obliquely from above and front right with three parallelly arranged devices according to the invention for fine processing of the optically effective surfaces of the spectacle lenses as polishing cells, a spectacle lens washing station adjacent thereto on the right, a conveyor belt for prescription boxes and a portal handling system for transport of the spectacle lenses, wherein to provide a view of significant components or subassemblies of the machine and for simplification of the illustration, in particular, the operating unit and control, parts of the cladding, door mechanisms and panes, further deposits for workpieces and tools, the supply devices (including lines, hoses and pipes) for power, compressed air and polishing medium, the polishing medium return as well as measuring, maintenance and safety devices have been omitted.

A polishing machine as preferred case of use or use location of a device 10 for fine processing of optically effective surfaces cc, cx at workpieces such as, for example, spectacle lenses L (cf. FIG. 8) is denoted by 11 in FIG. 1. In the illustrated embodiment, arranged in a common machine frame 12 as polishing cells are—in correspondence with the number of spectacle lens L to be polished—three such devices 10, 10', 10" of respectively identical construction. The device 10 on the right in FIG. 1, as representative for all three devices 10, 10', 10", will be explained in more detail in the following with reference to FIGS. 2 to 7. The device 10 comprises a workpiece spindle 14 which projects into a work space 13 and by way of which a spectacle lens L to be polished, which is usually secured by a blocking material M on a block piece S for mounting in the workpiece spindle 14 (see, again, FIG. 8), can be driven to rotate about a workpiece axis of rotation C. In addition, the device 10 comprises two tool spindles 16, 16', which are associated with the workpiece spindle 4714 and project oppositely into the work space 13 and on each of which a respective polishing tool 18, 18' is mounted to be drivable for rotation about a tool axis of rotation A, A' and to be axially adjustable along the tool axis of rotation A, A' also referred to as adjusting axes Z, Z'. The tool spindles 16, 16' are movable relative to the workpiece spindle 14 in common along a linear axis X extending substantially perpendicularly to the workpiece axis of rotation C and are pivotable about different pivot setting axes B, B', which extend substantially perpendicularly to the workpiece axis of rotation C and substantially perpendicularly to the linear axis X. In that case, the tool spindles 16, 16' are arranged one behind the other as seen in the direction of the linear axis X. This construction, which is part of one aspect of the invention shown n the device 10, can be best seen in FIG. 5.

Before the individual device 10 is described in detail, further details of its installation situation in the polishing machine 11 shall firstly be explained on the basis of FIG. 1. According to FIG. 1 the individual devices 10, 10', 10", which are operable independently of one another, are so arranged in compact manner adjacent to one another in modular form—and optionally to be separately exchangeable as a respective module—in the machine frame 12 that the respective linear axes X, X', X" extend substantially parallel to one another. This modular mode of construction allows, through identical subassemblies, production in common with corresponding batch number advantages and, moreover, permits flexible mounting of different manual or automatic variants.

Thus, in the embodiment illustrated in FIG. 1 a washing station 20, which is known per se, for washing the polished spectacle lenses L is mounted in the machine frame 12 adjacent to the device 10 on the right, and on the right adjacent to the washing station is a transfer station 21, here provided with a conveyor belt 22, for deposit of prescription boxes 23, which are customary in spectacle lens production, for reception of spectacle lenses L which are to be polished and which are polished. The prescription boxes 23 can be moved back and forth in the polishing machine 11 by the conveyor belt 22 in correspondence with the movement arrow depicted on the conveyor belt 22 in FIG. 1 (which as illustrated is in the axis X direction).

In addition, the automated variant, which is shown here, of the polishing machine 11 has a portal handling system 24 which automatically transports the spectacle lenses L between the stations 20, 21 and the devices 10, 10', 10" and positions the spectacle lenses L in the respective station 20, 21 or device 10, 10', 10". For that purpose, the portal handling system 24 comprises a suction unit 25, which is movable in three dimensions, for holding a spectacle lens 11, which is to be polished, at the optically effective surface cc to be polished and a multi-finger gripper 26, which is also movable in three dimensions, for holding a polished spectacle lens L at the edge thereof. The mentioned possibilities of three-dimensional movement are illustrated in FIG. 1 by movement arrows x, y, z (horizontal or vertical linear movements) and b (tilting movement about a transverse axis parallel to the horizontal movement direction y).

More specifically, the portal handling system 24 comprises two x linear units 28, 28' for producing the x movement, these units being arranged above the polishing machine 11 on either side of the machine frame 12. The x carriages 29, 29' thereof each carry a respective pivot mount 30, 30' which with the assistance of a pneumatic cylinder 31 enables tilting of a y linear unit 32, which is mounted on the pivot mounts 30, 30' and forms the portal, for producing the y movement through approximately 20°. Through this measure, a z linear unit 34 mounted on a y carriage 33 of the y linear unit 32 can be tilted out of the vertical in order to be adapted to a workpiece spindle inclined setting, which cannot be seen in the drawings and which arises when the devices 10, 10', 10" are in the state of being mounted in the machine frame 12. The suction unit 25 and the multi-finger gripper 26 are mounted on the z linear unit 34 to be longitudinally displaceable and, in particular, in such a manner that they can be moved in opposite sense by a common drive, i.e. if the suction unit 25 is moved downwardly the multi-finger gripper 26 at the same time moves upwardly and vice versa.

To that extent it will be evident to the expert that a spectacle lens L to be polished can be lifted (z) by the suction unit 25 of the portal handling system 24 out of a prescription box 23 on the transfer station by a movement of the z linear unit 34 and then can be moved in three dimensions (b, x, y) and inserted (z) at the inclined workpiece spindle 14 of the desired device 10, 10', 10" for processing by polishing. After the processing by polishing, the spectacle lens L polished to finished state can be lifted (z) by means of the multi-finger gripper 26 out of the respective device 10, 10', 10", transported (b, x, y) to the washing station 20 and inserted (z) into this for removal of polishing medium residues by washing. The clean spectacle lens L can subsequently be lifted (z) by the multi-finger gripper 26 out of the washing station 20, moved (x, y) to the respective prescription box 23 on the transfer station 21 and deposited (z) therein. The spectacle lenses L can accordingly be transported in that way or in analogous manner by the portal handling system 24 as desired or necessary back and forth between the devices 10, 10', 10" and stations 20, 21.

Figure 4:
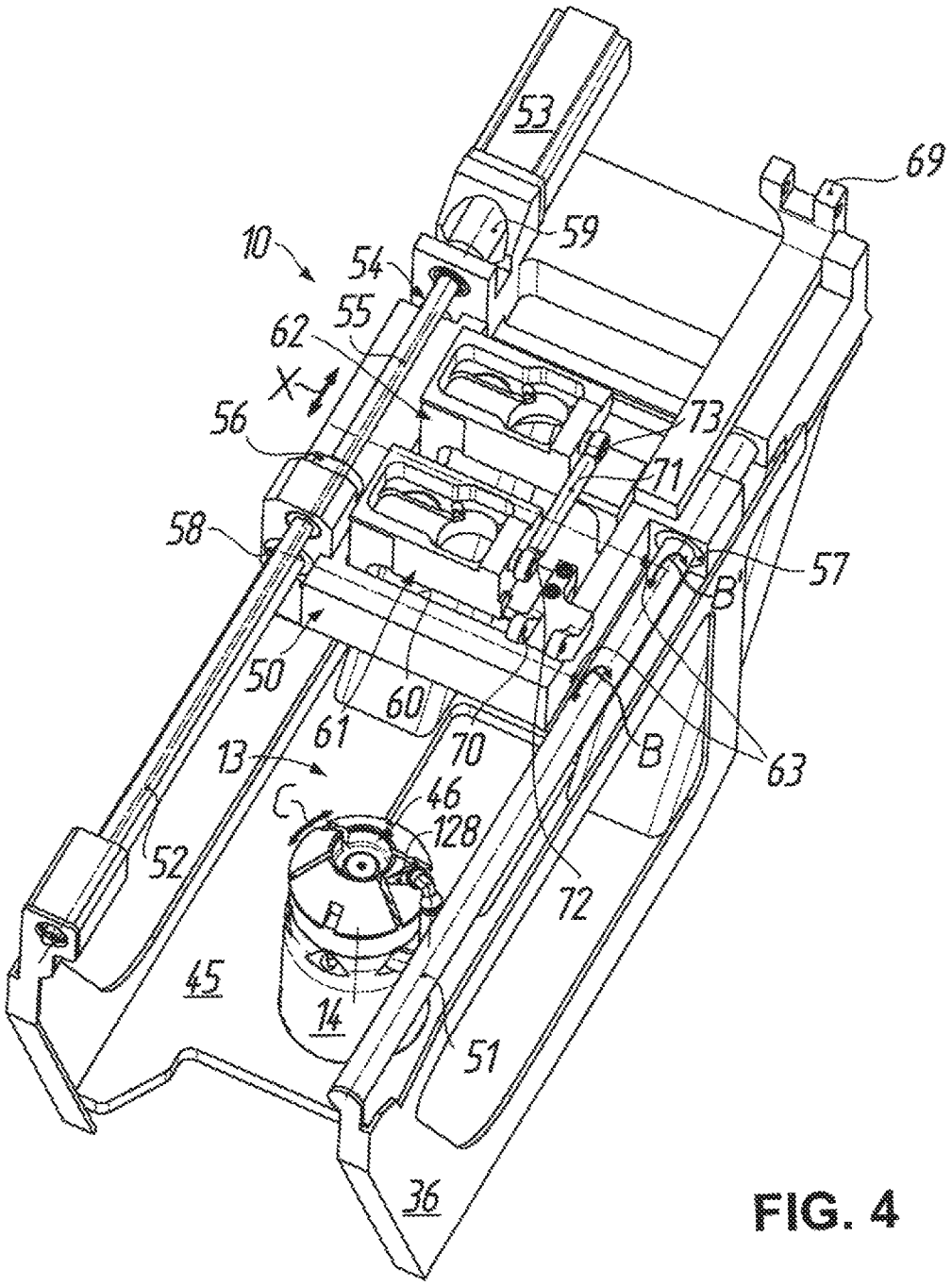
FIG. 4 shows a perspective view of the device according to FIG. 2 obliquely from above and front right, again with omission of the parts bounding the work space as well as the tool spindles and additionally the linear drive for the pivot setting axes B, B', but with illustrated workpiece spindle (workpiece axis of rotation C), particularly for illustration of pivot yokes (pivot setting axes B, B') for the tool spindles, which are arranged one behind the other, in the tool carriage (linear axis X)
Figure 5:
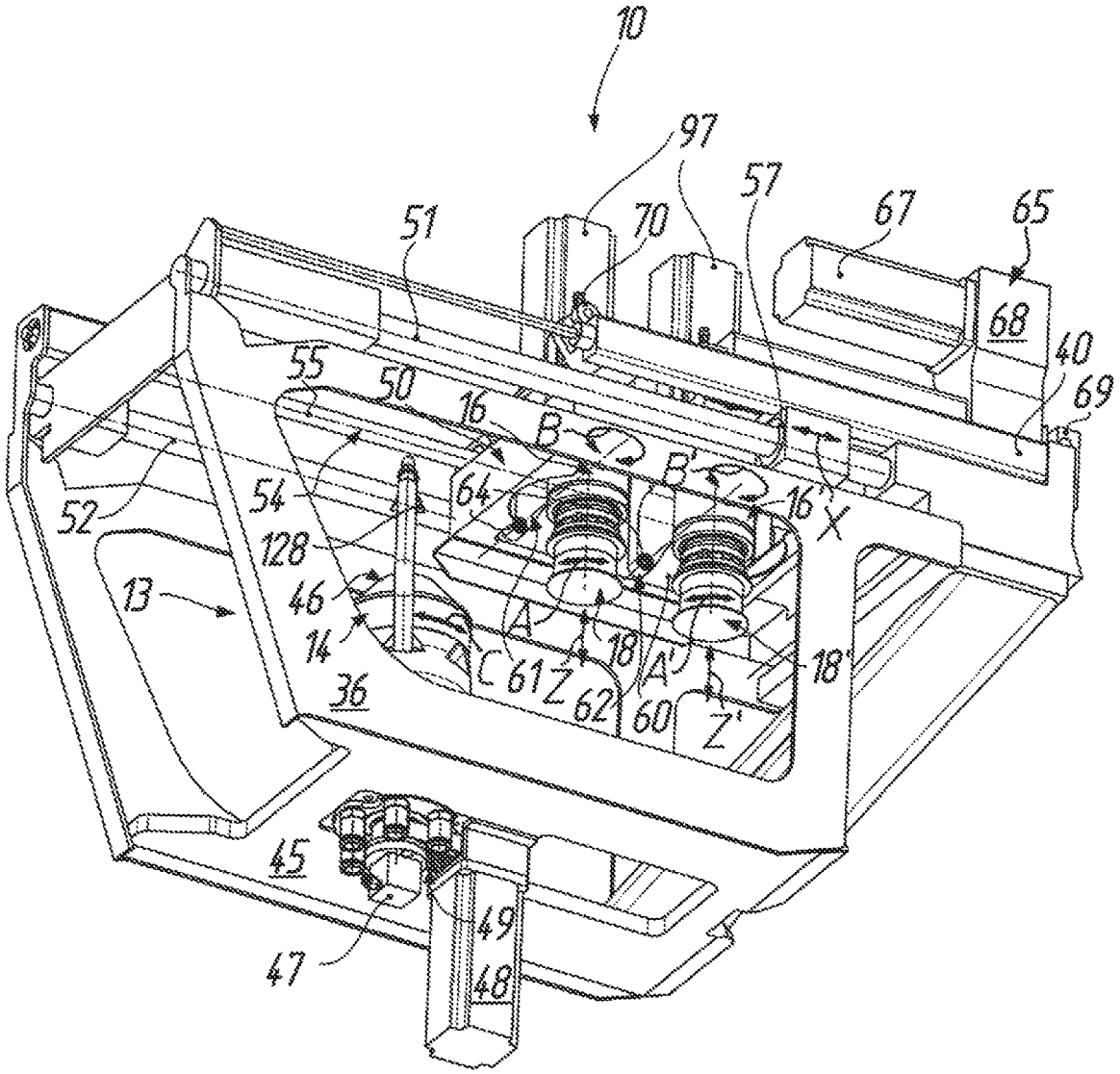
FIG. 5 shows a perspective view of the device according to FIG. 2 obliquely from below and front right with illustration of all movement axes or movement possibilities (tool axes of rotation A, A'; pivot setting axes B, B'; workpiece axis of rotation C; linear axis X; adjusting axes Z, Z') for the polishing process.
Figure 6:
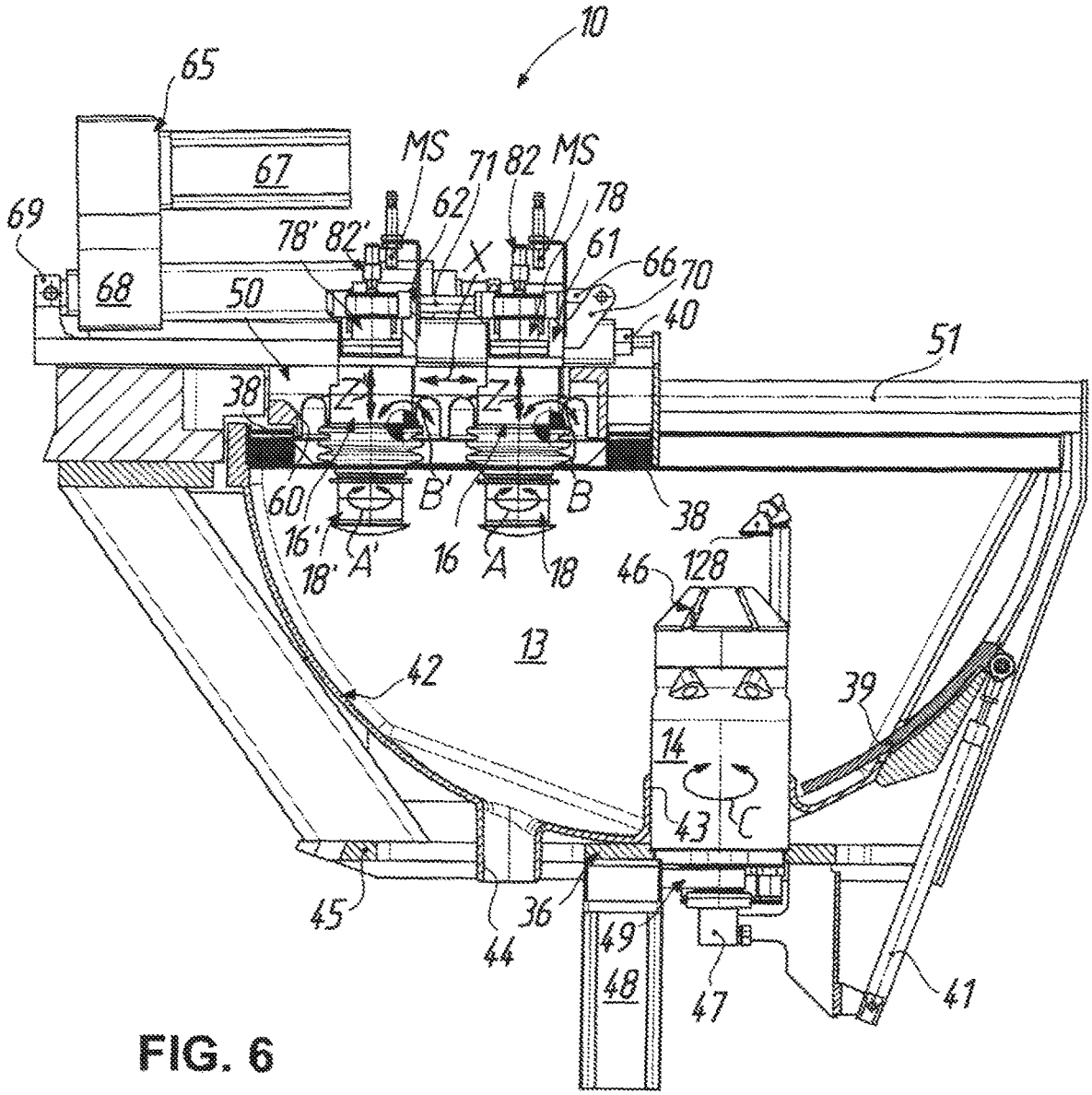
FIG. 6 shows a longitudinal sectional view of the device according to FIG. 2 with omission of components shown in FIG. 2, with the tool carriage (linear axis X) in the retracted setting, wherein for workpiece loading in the front region of the work space the sliding door is opened and the front bellows-like work space cover is retracted.
Figure 7:
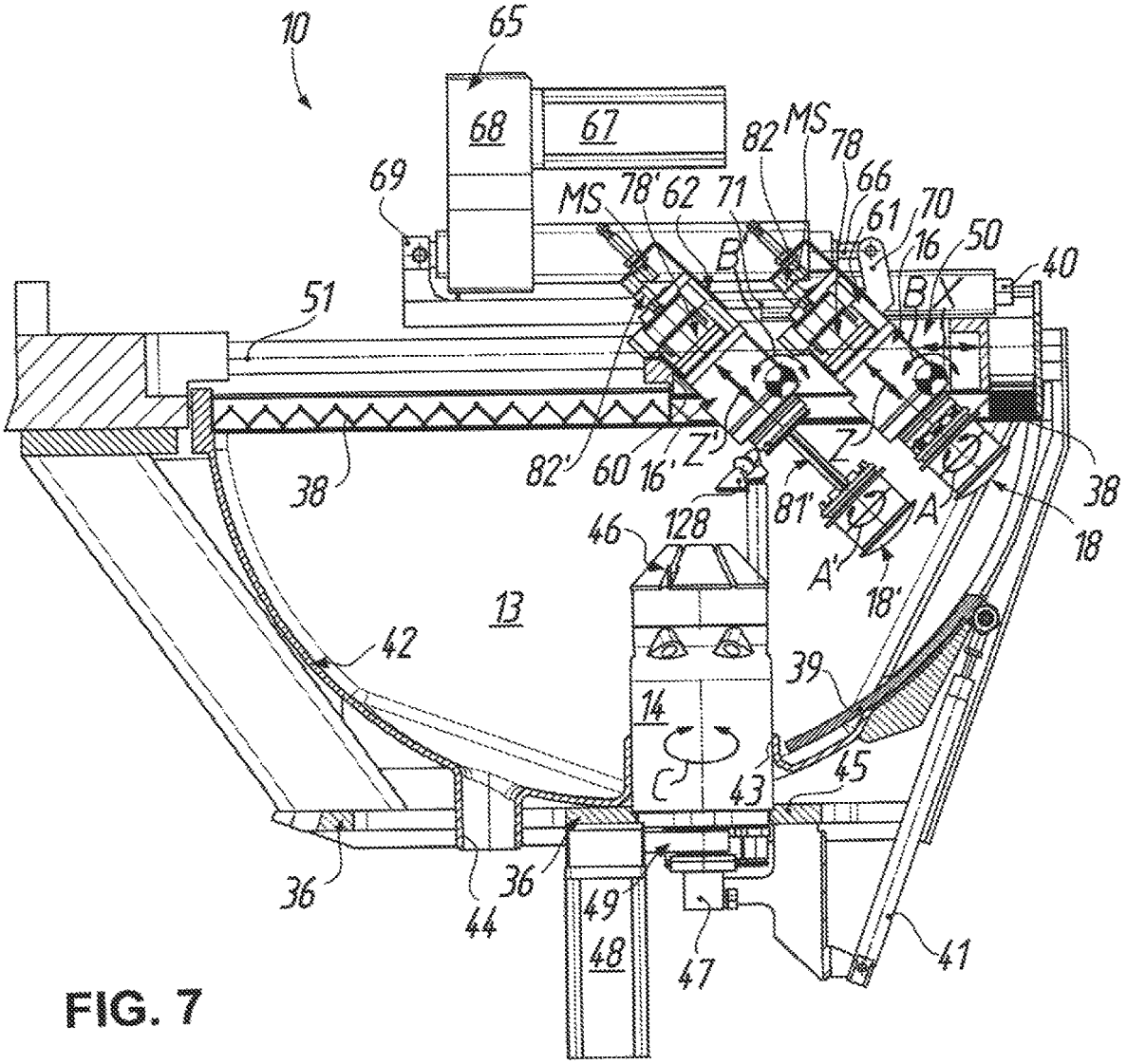
FIG. 7 shows a longitudinal sectional view, which corresponds with FIG. 6 with respect to the section plane, of the device according to FIG. 2, with the tool carriage (linear axis X) in an advanced setting for a tool change in which the tool spindles are pivoted forwardly (pivot setting axes B, B') and additionally the tool is moved out at the rear tool spindle (adjusting axis Z'), again with opened sliding door in the front region of the work space, wherein, by comparison with FIG. 6, bellows provided at the tool spindles have been omitted for simplification of the illustration.

For further description of the device 10 reference may now be made to FIGS. 2 to 7. According to, in particular, FIG. 4 the work space 13 of the device 10 is surrounded by a frame 36 which can be constructed as, for example, a welded construction of steel parts. Upwardly, the work space 13 can be covered by a bellows-like work space cover 38 and is closable at the front by a sliding door 39. In order to open the work space 13 for access from outside, the work space cover 38, which is suitably guided laterally, can be displaced or retracted by use of a pneumatic cylinder 40. In addition, a pneumatic cylinder 41 is provided for movement of the laterally guided sliding door 39 and is suitably pivotably connected between the sliding door 39 and the frame 36. Downwardly, the work space 13 is bounded by a trough 42, which is deep-drawn integrally from a plastics material and which is suitably fastened to the frame 36, with step-free wall surfaces, The trough 42 has a receiving opening 43 for the workpiece spindle 14 (cf. FIGS. 6 and 7), through which the workpiece spindle 14 extends—suitably sealed at the circumference—from below so as to project into a lower region of the work space 13. In FIGS. 6 and 7 there can also be seen a drain opening 44 for the liquid polishing medium, which is disposed at the deepest point of the trough 42 in the state in which the device 10 is mounted in the machine frame 12 and tilted downwardly to the left by comparison with the illustration in FIGS. 6 and 7.

Figure 3:
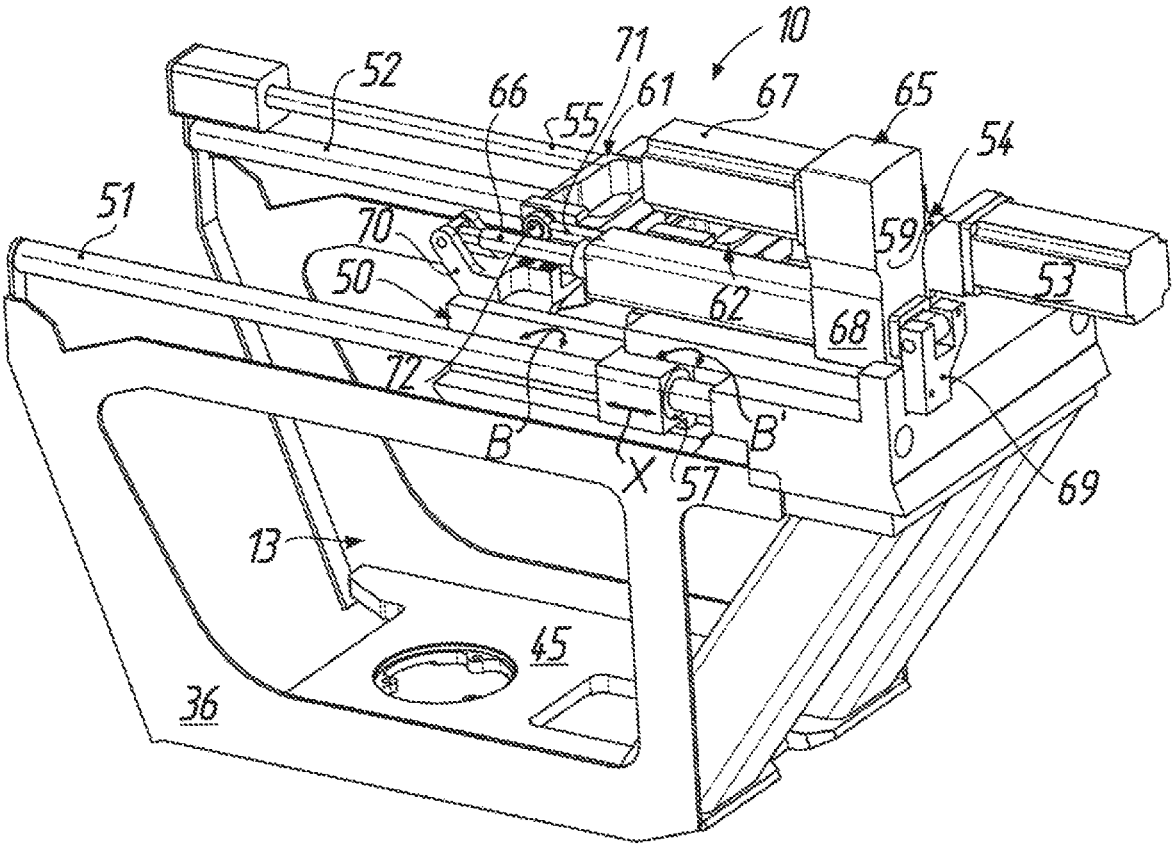
FIG. 3 shows a perspective view of the device according to FIG. 2 obliquely from above and rear right in which, by comparison with the illustration in FIG. 2, the parts (trough, sliding door, bellows-like work space covers) bounding the work space as well as the workpiece and tool spindles have been omitted, particularly for illustration of a linear drive for the pivot setting axes B, B'.

As can be seen in FIGS. 3 to 7, the frame 36 has a base plate 45 at which the workpiece spindle 14 is flange-mounted below the receiving opening 43 in the trough 42 from above (see, in particular, FIGS. 4, 6 and 7). At its end projecting into the work space 13 the workpiece spindle 14 has a collet chuck 46 which can be actuated by way of an actuating mechanism (not illustrated in more detail) so as to clamp a spectacle lens L, which is blocked on a block piece S, to the workpiece spindle 14 to be axially fixed and capable of rotational entrainment. A pneumatic cylinder, which is fastened below the base plate 45, for the said actuating mechanism is denoted by 47 (cf. FIGS. 5 to 7), by which the collet chuck 46 can be opened and closed in a manner known per se. As can be similarly seen in FIGS. 5 to 7, a rotary drive 48—in the illustrated embodiment a speed-controlled asynchronous three-phase motor—is flange-mounted from below on the base plate 45. The rotary drive 48—similarly below the base plate 45—is drivingly connected by means of a cogged belt drive with the roller-bearing-mounted spindle shaft of the workpiece spindle 14 so that the rotary drive 48 is capable of rotationally driving the workpiece spindle 14 at a predetermined rotational speed and with a predetermined direction of rotation (workpiece axis of rotation C).

A tool carriage 50 which is guided with respect to the frame 36 to be drivable along the linear axis X is provided above the workpiece spindle 14 for movement in common of the workpiece spindles 16, 16'. More precisely, provided for movement and positioning of the tool carriage 50, which is guided at two parallel guide rods 51, 52 connected with the frame 36 on opposite sides, is a rotary drive 53 which is mounted on the frame 36 in fixed location and which is drivingly connected with a ball screw drive 54. The latter has an axially fixed ball screw spindle 55, which is rotatably mounted at both ends and which is in engagement with a nut 56 connected with the tool carriage 50 to be secure against relative rotation. In that case, the tool carriage 50 according to FIGS. 3 to 5 is guided at one guide rod 51 merely by way of one axial bearing 57 (ball bush), whereas it is guided at the other guide rod 52 by way of two axial bearings 58 (ball bushes) which are axially spaced from one another in the direction of the guide rod 52 and of which merely the front axial bearing 58 can be seen in FIGS. 2 and 4. The rotary drive 53 for moving the tool carriage 50 is a servomotor, which is connected with the ball screw spindle 55 by way of, for example, a metal bellows coupling 59. The thus-constructed substantially horizontally extending linear axis X is subject to CNC positional closed loop control; however, for simplification of the illustration the associated travel measuring system is not shown.

Figure 2:
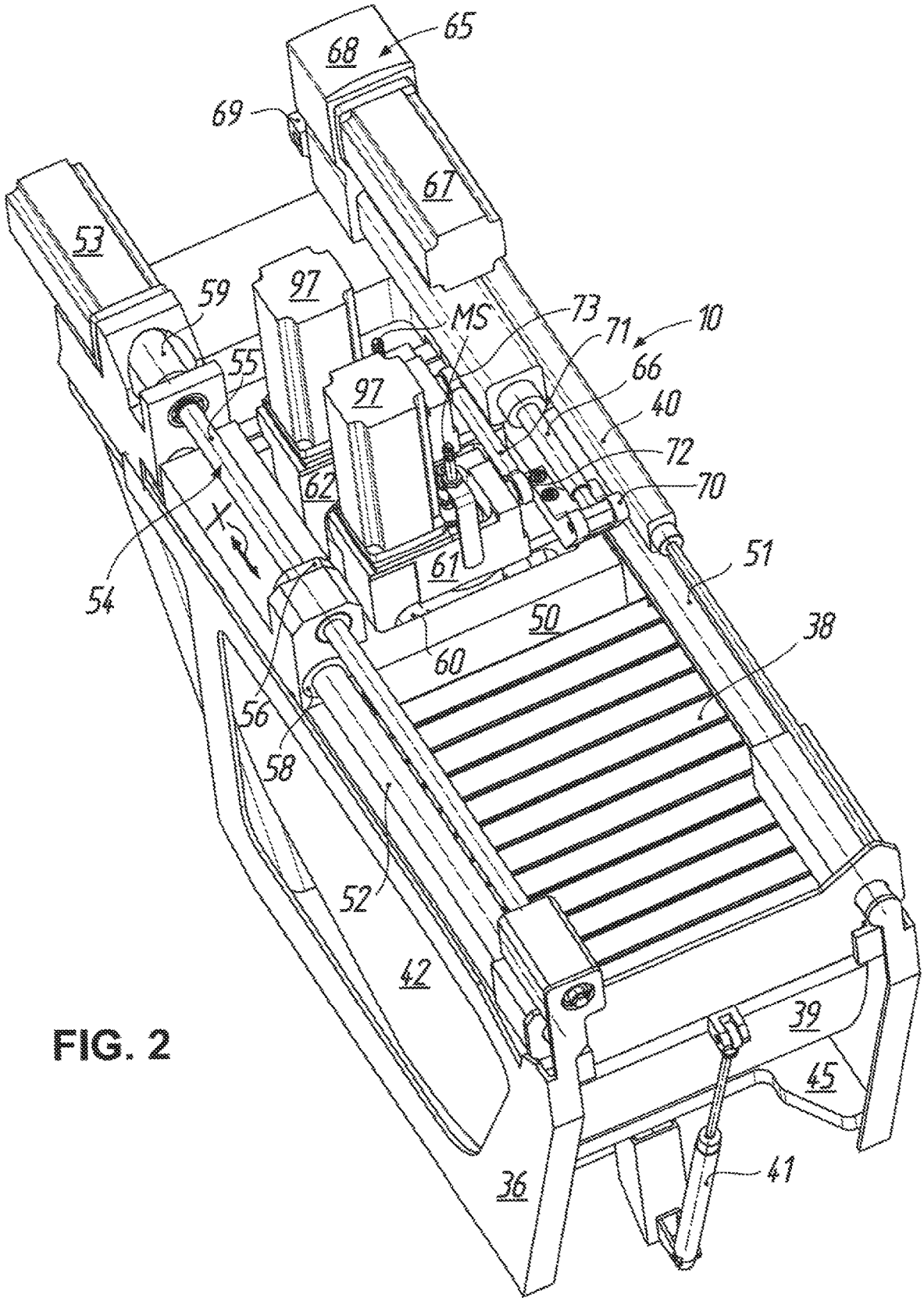
FIG. 2 shows a perspective view of the device according to the invention—separately from the polishing machine according to FIG. 1 and there on the right—obliquely from above and front left as a separate polishing cell, wherein a tool carriage (linear axis X) for the tool spindles is disposed in a retracted setting and a work space, which is bounded downwardly by a trough, is closed by a bellows-like work space cover and a sliding door.

As can be best seen in FIGS. 2, 4 and 5, the tool carriage 50 has a frame construction with an inner opening 60, which is substantially rectangular as seen in plan view, for receiving the two pivotable tool spindles 16, 16'. In that case one, i.e. front, tool spindle 16 is mounted on or in a front pivot yoke 61, which is pivotably connected with the tool carriage 50 on either side of the opening 60 to be capable of defined pivotation about one pivot setting axis B, and the other tool spindle 16' is mounted on a rear pivot yoke 62, which is pivotably connected with the tool carriage 50 behind the front pivot yoke 61 to be capable of defined pivotation about the other pivot setting axis B' again on either side of the opening 60. The corresponding bearing points present on either side of the opening 60 and at the carriage side or yoke side can be seen in FIGS. 4 and 5 at 63 and 64. From the schematic illustration in FIGS. 6 and 7 with respect thereto, it is evident with regard to the height of the bearing points 63, 64 that the two pivot setting axes B, B' lie in a notional plane which extends along the linear axis X or parallel thereto.

A further linear drive 65 is provided for drive of the pivot yokes 61, 62, i.e. for defined pivotation in common of the two tool spindles 16, 16' about the pivot setting axes B, B' and is pivotably connected by one end thereof with the front pivot yoke 61 at a spacing from the corresponding pivot setting axis B and by the other end thereof with the tool carriage 50. More specifically, in the illustrated embodiment the linear drive 65 is a proprietary so-called "electrocylinder" with an actuating rod 66 which can be moved in and out by way of a rotary drive 67 and a transmission 68 in the case of corresponding energization of the rotary drive 67. If the rotary drive 67 is not energized, self-locking is present in the transmission 68, i.e. the actuating rod 66 remains in its respective initial setting in the case of non-excessive external forces; an integrated measuring system can feed back the respective position. This linear drive 65 is pivotably mounted at its end at the drive side on a mounting fork 69 mounted on the tool carriage 50, whereas at the other end of the linear drive 65 the actuating rod 66 pivotably engages a forked pivot arm 70 secured to the front pivot yoke 61 (see the screws in this region in FIGS. 2 to 4). For transmission of the pivot movement from the front pivot yoke 61 to the rear pivot yoke 62 the two pivot yokes 61, 62 are in drive connection by way of a coupling rod 71 which is spaced from the pivot setting axes B, B', in particular above the latter by one end thereof at the front pivot yoke 61 (bearing point 72) and by the other end thereof at the rear pivot yoke 62 (bearing point 73).

In that respect it is apparent that in the case of the chain of pivotation formed as described above a defined axial movement out or movement in of the actuating rod 66 has the consequence that the pivot yokes 61, 62 are pivoted in defined manner about the pivot setting axes B, B', whereby the tool spindles 16, 16', which are arranged centrally in the respective pivot yoke 61 or 62, are pivoted while remaining in parallel orientation relative to one another.

Figure 8:
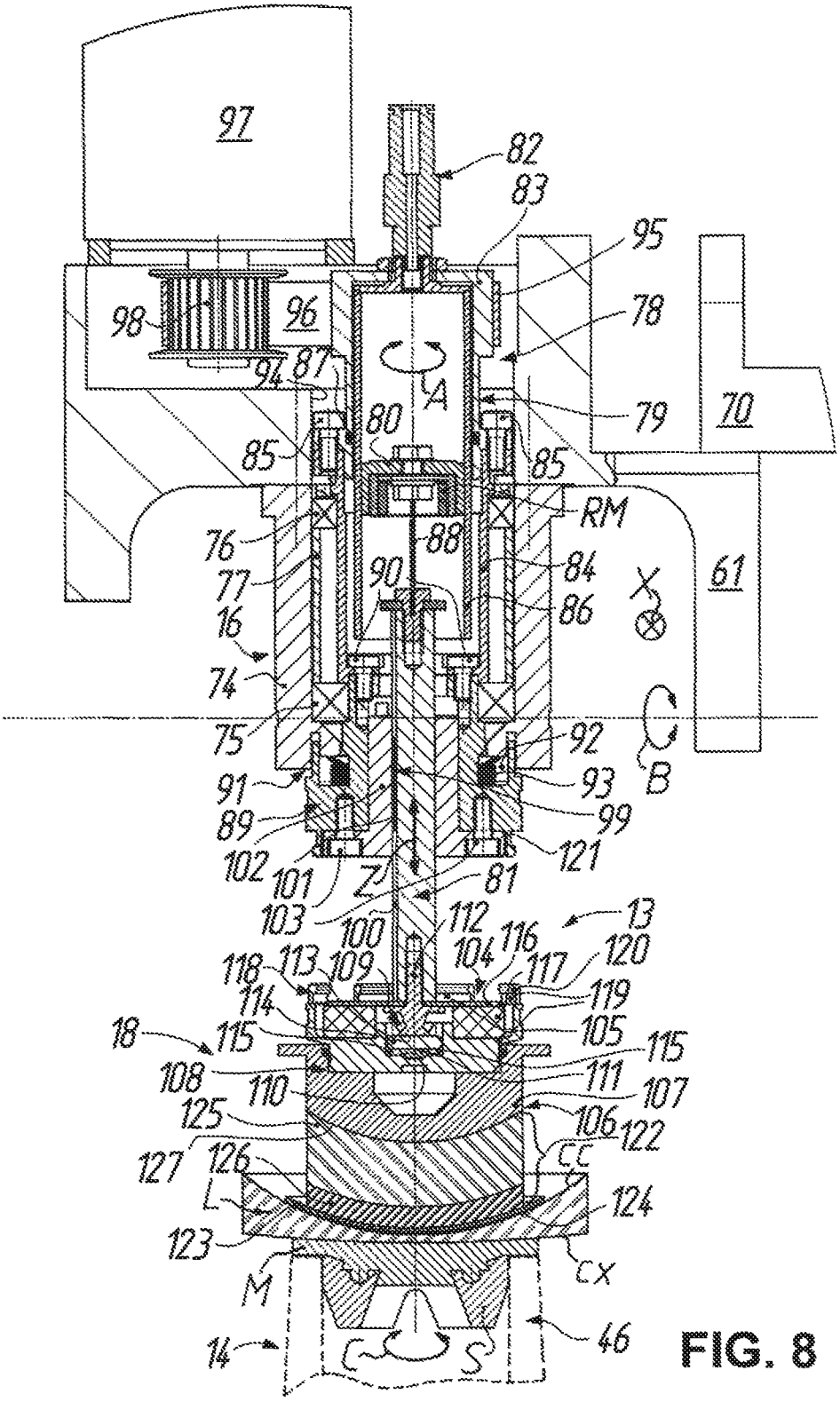
FIG. 8 shows a longitudinal section view of the front tool spindle, which is mounted in the front pivot yoke—illustrated partly broken away—of the device according to FIG. 2, with a polishing tool, at the tool mounting head of which is detachably mounted a polishing disc disposed in processing engagement with a surface to be processed, wherein the polishing tool is disposed in a lower setting moved out (adjusting axis Z) relative to the tool spindle and the associated bellows have been omitted for simplification of the illustration.
Figure 9:
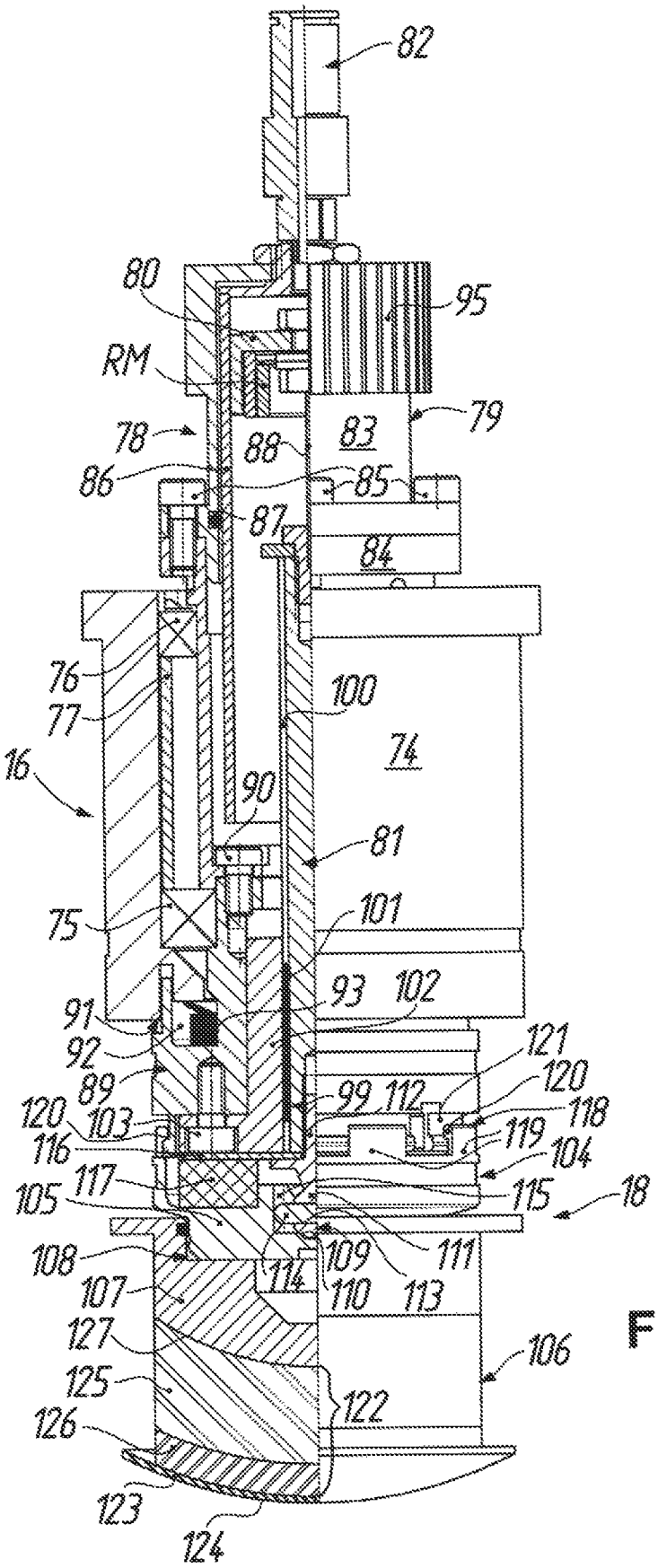
FIG. 9 shows a half section of the front tool spindle with polishing tool according to FIG. 8 in demounted state, again without bellows between polishing tool and tool spindle, wherein the polishing tool together with the polishing disc is disposed in an upper setting which is moved in (adjusting axis Z) relative to the tool spindle and in which the tool mounting head of the polishing tool is detented at the workpiece spindle.

Further details with respect to the tool spindles 16, 16' can be inferred from FIGS. 8 and 9, which by way of example show, for the two identically constructed tool spindles 16, 16' coupled to the respective pivot yoke 61, 61, the front tool spindle 16 (also) in section.

The tool spindle 16 comprises a spindle housing 74, by way of which the tool spindle 16 according to FIG. 8 is flange-mounted from below on the pivot yoke 61. The dot-dashed lines shown in FIG. 8 indicate a screw connection. The further components or subassemblies of the tool spindle 16 are rotatably mounted in the spindle housing 74 by way of a bearing arrangement of roller bearings comprising a lower fixed bearing 75 and an upper floating bearing 76, which are mounted in the spindle housing 74 at a spacing from one another by means of a spacer bush 77.

Each tool spindle 16, 16' has a piston-cylinder arrangement 78, 78' (also indicated in FIGS. 6 and 7) for axial adjustment (adjusting axes Z, Z') of the respective polishing tool 18, 18' along the associated tool axis of rotation A, A'. The piston-cylinder arrangement 78 has a piston 80 which is received in a cylinder housing 79 and which is connected, to be effective in terms of actuation, in coaxial arrangement with a spindle shaft 81 movable out of the spindle housing 74 in accordance with FIG. 8 (and FIG. 7). For movement of the spindle shaft 81 out of the spindle housing 74 the piston-cylinder arrangement 78 can be acted on pneumatically by way of a proprietary rotary transmission lead-through 82 at the end of the cylinder housing 79 at the top in the figures. In that case, the piston-cylinder arrangement 78 together with the spindle shaft 81 is rotatable in the spindle housing 74 about the tool axis of rotation A, as already indicated.

According to FIGS. 8 and 9, the cylinder housing 79 is, in addition, of two-part construction with a housing upper part 83 and a housing lower part 84, which are screw-connected together centered relative to one another at 85. In that regard, received in the interior for lining the cylinder housing 79 is a guide sleeve 86 of mineral glass which is secured in the housing upper part 83 with the assistance of an O-ring 87 and in which the piston 80, which is made from a graphite material at its guide surface, is received to be longitudinally displaceable. Glass cylinders of that kind, which are very easy-running and substantially free of stick-slip, are commercially available from, for example, the company Airpot Corporation, Norwalk, Conn., United States. In order to avoid jamming, which can result from axial alignment errors in the coaxially arranged components, the piston 80 of the piston-cylinder arrangement 78 is tension-resistantly and compression-resistantly connected with the spindle shaft 81 by way of a thin rod 88 of spring steel and, in particular, by way of the screw connections shown in FIGS. 8 and 9 at the top and bottom at the rod 88.

The housing lower part 84 of the cylinder housing 79 is rotatably supported by way of the floating bearing 76 in radial direction on the spindle housing 74 at the top in the figures. At the bottom in the figures, a labyrinth member 89 is flange-mounted on the housing lower part 84 by means of a screw connection 90 which in that case together with the housing lower part 84 axially clamps the inner ring of the fixed bearing 75 in place. The labyrinth member 89 forms, as the name itself indicates, together with the underside of the spindle housing 74 at 91 a sealing labyrinth with narrow gap dimensions and additionally has radially within the sealing labyrinth 91 an annular recess 92 for reception of a sealing ring 93, the sealing lip of which similarly sealably co-operates with the lower side of the spindle housing 74.

As FIG. 8 shows, the housing upper part 83 of the cylinder housing 79 passes through an opening 94 formed in the pivot yoke 61 and projects upwardly above this in FIG. 8. The housing upper part 83 of the cylinder housing 79 is there provided at the outer circumference with a toothing 95 (cf. FIG. 9) for engagement by a cogged belt 96. The cogged belt 96 is drivable by way of a motor 97—which is flange-mounted from above on the pivot yoke 61 and is similarly of identical construction for each pivot yoke 61, 62—with a belt pulley 98 so as to rotate the piston-cylinder arrangement 78 and thus the spindle shaft 81 in the spindle housing 74 controllably in rotational speed and rotational direction about the tool axis of rotation A.

In addition, provided for torque transmission from the thus-rotating drivable cylinder housing 79 of the piston-cylinder arrangement 78 to the spindle shaft 81 is a splined shaft guide 99 with guide grooves 100, which are formed in the spindle shaft 81, and a flange nut 102, which is in engagement therewith by way of an axial bearing element 101—since it is known per se, it is indicated in FIGS. 8 and 9 merely by a thick line—and which is received in the labyrinth member 89 and flange-mounted thereon by means of a screw connection 103, so that the flange nut 102 is connected with the cylinder housing 79 to be secure against relative rotation. Splined shaft guides of that kind are commercially available from, for example, the company Nippon Bearing Co Ltd, Ojiya-City, Japan.

To that extent it is evident that the spindle shafts 81, 81' of the tool spindles 16, 16' are drivable—controllably in rotational speed and rotational direction—at a given time independently of one another for rotation about the tool axes of rotation A, A' and/or adjustable independently of one another along the tool axes of rotation A, A', in a given case also with very fine sensitivity (adjusting axes Z, Z').

Details with respect to the polishing tool 18, which is currently preferred for use in this device 10, can similarly be inferred from FIGS. 8 and 9. According to that, the polishing tool 18 has a tool mounting head 104 with a mounting plate 105 which is secured to the spindle shaft 81 of the tool spindle 16 to be capable of axial and rotational entrainment and at the same time to be detachable.

A polishing disc 106 is exchangeably mounted on the tool mounting head 104, for which purpose a base body 107 of the polishing disc 106 and the tool mounting head 104, more precisely the mounting plate 105 thereof, are provided with complementary structures 108 for axial detenting and rotational entrainment of the polishing disc 106 by the tool mounting head 104. This interface, which is formed by the complementary structures 108, between polishing disc 106 and tool mounting head 104 is the subject of document U.S. Pat. No. 9,089,948, to which, for avoidance of repetitions, express incorporation by reference is hereby made at this point with regard to construction and function of the interface.

On the side of the mounting plate 105 remote from the polishing disc 106 the tool mounting head 104 has a ball joint 109 with a ball head 111 which is received in a ball socket 110 and which is constructed at a ball pin 112 securable to the spindle shaft 81 of the tool spindle 16, more precisely able to be screwed in at the end thereof. On the other hand, the ball socket 110 is formed in the mounting plate 105 with which the polishing disc 106 is detentable. In the illustrated embodiment the ball head 111 has a receiving bore 113 for a transverse pin 114, which extends through the ball head 111 by radiused ends and engages on either side of the bore head 111 in associated recesses 115 in the ball socket 110 so as to connect the mounting plate 105 in the manner of a universal joint with the ball head 111 and thus with the spindle shaft 81 of the tool spindle 16 to be capable of rotational entrainment.

In addition, a circularly annular support flange 116 is introduced between the ball pin 112 and the free end of the spindle shaft 81. The ball pin 112 secures the support flange 116 to the spindle shaft 81. A resilient annular element 117 made from, for example, a suitable foam material rests on the support flange 116, by way of which annular element the mounting plate 105 of the tool mounting head 104 can be resiliently supported on the support flange 116 at the ball pin side in such a manner that the polishing disc 106 detented with the mounting plate 104 seeks to self-align by its center axis with the ball pin 112 and thus the spindle shaft 81 of the tool spindle 16.

In addition, it can be seen in FIGS. 8 and 9 that the tool mounting head 104 in an axially retracted setting of the spindle shaft 81 (cf. FIG. 9) can be detented with the labyrinth member 89—as a part connected with the cylinder housing 79 to be secure against relative rotation—by means of a detent device 118. The detent device 118 has a plurality of spring projections 119, which are distributed around the circumference of the tool mounting head 104 and protrude along the tool axis of rotation A and which are in mechanically positive engagement with lugs 120 in an annular groove 121 formed at the labyrinth member 89. The polishing tool 18 can thus be mounted without force by detenting in a retracted setting at the tool spindle 16. For recognition of the moved-up position of the polishing tool 18—and thus a tool loading position of the tool spindle 16—an annular magnet RM is glued in place in the piston 80 of the piston-cylinder arrangement 78 and co-operates with a magnet sensor MS (see FIGS. 2, 6 and 7) in the vicinity of the rotary transmission leadthrough 82.

An intermediate layer 122, which is softer by comparison with the base body 107 and on which a polishing medium carrier 123 rests, of a resilient material is secured to the base body 107 of the polishing disc 106 illustrated here. The polishing medium carrier 123 forms the actual outer processing surface 124 of the polishing disc 106. In this structure of the polishing disc 106 the intermediate layer 122 has at least two regions of different hardness which are arranged one behind the other in the direction of the center axis of the polishing disc 106, wherein the region of the intermediate layer 122 adjoining the base body 107 is softer than the region of the intermediate layer 122 on which the polishing medium carrier 123 rests. More precisely, the two regions of the intermediate layer 122 are here formed by mutually different foam material layers 125, 126 of respectively constant thickness as seen along the center axis of the polishing disc 106 namely a softer foam material layer 125 on the base body 107, more precisely the spherical end surface 127 thereof, and a harder foam material layer 126 under the polishing medium carrier 123. The individual components (107, 125, 126, 123) of the polishing disc 106 are glued together. This polishing disc 106, which is universally usable for a wide range of workpiece curvatures, in particular the actual construction and dimensioning thereof, is the subject of parallel, i.e. filed on the same application date, U.S. Ser. No. 15/519,662 (See also German Patent Application DE 10 2014 015 052.6 which is hereby incorporated by reference for avoidance of repetitions.

Other polishing tools or polishing discs can obviously also be used with the device 10 in correspondence with the respective polishing requirements. Thus, for example, it would be possible to use tools according to the document U.S. Pat. No. 7,559,829 B2 which is hereby incorporated by reference without an individual rotary drive. In this case, mounting bore and transverse pin would be just as redundant in the ball head of a somewhat longer ball pin as the support flange and the resilient annular element of the polishing tool illustrated here. Instead, a flange, which is similar, but somewhat larger in diameter, with an outer radial groove for receiving a bellows would be used. Since the device 10 has the two spindles 16, 16' arranged one behind the other, a "mixed drive" would also be possible, with an active rotationally driven polishing tool 18, as shown in the figures, at one tool spindle 16 and a merely "passive" rotationally entrained polishing tool according to, for example, document U.S. Pat. No. 7,559,829 B2 at the other tool spindle 16'.

The different polishing processes able to be performed by the afore-described kinematics of the device 10—in which moreover a liquid polishing medium is supplied to the point of action between tool and workpiece by way of polishing medium nozzles 128 provided at the workpiece spindle 14 (see FIGS. 4 to 7, in which one such nozzle is illustrated by way of example for a plurality of nozzles distributed at the circumference of the workpiece spindle 14)—are well-known to one ordinarily skilled in the art and therefore shall not be described in more detail at this point.

A device for fine processing of optically effective surfaces of, in particular, spectacle lenses as workpieces comprises a workpiece spindle, which projects into a work space and by way of which a workpiece to be polished is rotationally drivable about a workpiece axis of rotation (C), and two tool spindles associated with the workpiece spindle and projecting oppositely into the work space. A respective polishing tool is mounted on each of the tool spindles to be drivable for rotation about a tool axis of rotation (A, A') and axially adjustable (adjusting axis Z, Z') along the tool axis of rotation. In addition, the tool spindles are movable in common relative to the workpiece spindle along a linear axis (X) extending substantially perpendicularly to the workpiece axis of rotation and pivotable about different pivot setting axes (B, B') extending substantially perpendicularly to the workpiece axis of rotation and substantially perpendicularly to the linear axis. In that case, the tool spindles are arranged one behind the other as seen in the direction of the linear axis. As a consequence of such an arrangement the device is of very compact construction and is widely usable for different polishing processes and polishing strategies.

Variations and modifications are possible without departing from the scope and spirit of the present invention as defined by the appended claims.

The invention claimed is:

1. A device for fine processing of optically effective surfaces of, spectacle lenses as workpieces, comprising a workpiece spindle, which projects into a work space and by way of which a workpiece to be polished is drivable for rotation about a workpiece axis of rotation, and two tool spindles which are both associated with the workpiece spindle and project oppositely into the work space and on each of which a respective polishing tool is mounted to be drivable for rotation about a tool axis of rotation and to be axially adjustable along the tool axis of rotation, the tool spindles having their respective axis of rotation being movable in common relative to the workpiece spindle along a linear axis extending substantially perpendicularly to the workpiece axis of rotation and being pivotable about different pivot setting axes extending substantially perpendicularly to the workpiece axis of rotation and substantially perpendicularly to the linear axis, wherein the tool spindles are arranged one behind the other as seen in a direction of the linear axis and are movable along the linear axis such that either tool spindle can be positioned to operate with the workpiece spindle.

2. A device according to claim 1, wherein the pivot setting axes lie in a notional plane extending along the linear axis or parallel thereto.

3. A device according to claim 1, wherein one tool spindle is mounted on a front pivot yoke, which is pivotably connected with a tool carriage to be capable of defined pivotation about one pivot setting axis, whereas the other tool spindle is mounted on a rear pivot yoke, which is pivotably mounted on the tool carriage to be capable of defined pivotation about the other pivot setting axis, the carriage in turn being guided with respect to a frame, which surrounds the work space, to be drivable along the linear axis.

4. A device according to claim 3, wherein provided for movement and positioning of the tool carriage, which is guided on two guide rods connected with the frame, is a rotary drive which is stationary with respect to the frame and disposed in drive connection with a ball screw drive having a rotatably mounted ball screw spindle which engages a nut connected with the tool carriage to be secure against relative rotation.

5. A device according to claim 3, wherein provided for defined pivotation of the two tool spindles about the pivot setting axes is a linear drive which is pivotably connected by one end thereof with one pivot yoke at a spacing from the corresponding pivot setting axis and by the other end thereof with the tool carriage, and wherein the one pivot yoke is drivingly connected with the other pivot yoke by way of a coupling rod which, at a spacing from the pivot setting axes, is pivotably connected by one end thereof with the one pivot yoke and by the other end thereof with the other pivot yoke.

6. A device according to claim 1, wherein each tool spindle has for axial adjustment of the respective polishing tool along the associated tool axis of rotation a piston-cylinder arrangement with a piston, which is received in a cylinder housing and which is connected in coaxial arrangement with a spindle shaft to be effective for actuation, the spindle shaft together with the piston-cylinder arrangement being mounted in a spindle housing to be rotatable about the respective tool axis of rotation.

7. A device according to claim 6, wherein the piston-cylinder arrangement is pneumatically actuable, and wherein the cylinder housing of the pneumatically actuable piston-cylinder arrangement is of two-part construction and lined by a guide sleeve of mineral glass in which the piston, which at its guide surface is made from a graphite material, is received to be longitudinally displaceable.

8. A device according to claim 6, wherein the piston of the piston cylinder arrangement is rigidly connected with the spindle shaft by way of a thin rod of spring steel.

9. A device according to claim 6, wherein the cylinder housing is provided at the outer circumference with a toothing for engagement of a cogged belt which is drivable by way of a motor, which is flange-mounted on the respective pivot yoke, with a belt pulley so as to rotate the piston-cylinder arrangement and thus the spindle shaft about the respective tool axis of rotation.

10. A device according to claim 6, wherein provided for torque transmission from the cylinder housing of the piston-cylinder arrangement to the spindle shaft is a splined shaft guide with guide grooves formed in the spindle shaft and a flange nut which is engaged with the grooves by way of an axial bearing element and which is connected with the cylinder housing to be secure against relative rotation.

11. A device according to claim 6, wherein the polishing tool comprises a tool mounting head which is securable to the respective spindle shaft to be capable of axial and rotational entrainment and on which a polishing disc is exchangeably mounted, for which purpose a base body of the polishing disc and the tool mounting head are provided with complementary structures for axial detenting and for rotational entrainment of the polishing disc by the tool mounting head.

12. A device according to claim 11, wherein the tool mounting head has a ball joint with a ball head, which is received in a ball socket and which is formed on a ball pin securable to the spindle shaft of the respective tool spindle, the ball socket being formed in a mounting plate with which the polishing disc is detentable.

13. A device according to claim 12, wherein the ball head has a receiving bore for a transverse pin which extends through the ball head and engages on either side of the ball head with associated recesses in the ball socket so as to connect the mounting plate with the ball pin to be capable of rotational entrainment.

14. A device according to claim 12, wherein the mounting plate is so resiliently supported by way of a resilient annular element on a support flange at the ball pin side that the polishing disc detented with the mounting plate seeks to self-align by its center axis with the ball pin and thus the spindle shaft of the respective tool spindle.

15. A device according to claim 11, wherein the tool mounting head in an axially retracted setting of the spindle shaft is detentable by means of a detent device with the cylinder housing or a part connected therewith to be secure against relative rotation.

16. A device according to claim 15, wherein the detent device comprises a plurality of spring projections which are distributed over the circumference of the tool mounting head and project along the respective tool axis of rotation and which mechanically positively engage with lugs in an annular groove formed at the cylinder housing or the part connected therewith to be secure against relative rotation.

17. A device according to claim 1, wherein a lower region of the work space into which the workpiece spindle projects is bounded by a trough which is integrally deep-drawn from a plastics material and has step-free wall surfaces.

18. A polishing machine for simultaneous polishing of at least two spectacle lenses, comprising a machine frame in which in correspondence with the number of spectacle lenses to be simultaneously polished at least two devices are arranged, each device having a workpiece spindle, which projects into a work space and by way of which a workpiece to be polished is drivable for rotation about a workpiece axis of rotation, and two tool spindles which are both associated with the workpiece spindle and project oppositely into the work space and on each of which a respective polishing tool is mounted to be drivable for rotation about a tool axis of rotation and to be axially adjustable along the tool axis of rotation, the tool spindles having their respective axis of rotation being movable in common relative to the workpiece spindle along a linear axis extending substantially perpendicularly to the workpiece axis of rotation and being pivotable about different pivot setting axes extending substantially perpendicularly to the workpiece axis of rotation and substantially perpendicularly to the linear axis, wherein the tool spindles are arranged one behind the other as seen in a direction of the linear axis and are movable along the linear axis such that either tool spindle can be positioned to operate with the workpiece spindle.

19. A polishing machine according to claim 18, wherein the devices are arranged adjacent to one another so that the respective linear axes extend substantially parallel to one another.

20. A polishing machine according to claim 18, with a transfer station, which has a conveyer belt, for deposit of prescription boxes for reception of spectacle lenses which are to be polished and which are polished, a washing station for washing the polished spectacle lenses and a portal handling system, which automatically transports the spectacle lenses between the stations and the devices and positions the spectacle lenses in the respective station or device.

21. A polishing machine according to claim 20, wherein the portal handling system comprises a three-dimensionally movable suction unit for holding a spectacle lens, which is to be polished, at the optically effective surface to be polished and a three-dimensionally movable multi-finger gripper for holding a polished spectacle lens at the edge thereof.

* * * * *